United States Patent [19]

Sakurai

[11] 4,177,560

[45] Dec. 11, 1979

[54] SAFETY KNIFE

[76] Inventor: Hiroshi Sakurai, 7-2 Inago-cho, Seki-shi, Gifu, Japan

[21] Appl. No.: 931,881

[22] Filed: Aug. 8, 1978

[30] Foreign Application Priority Data

Oct. 22, 1977 [JP] Japan ..... 52/142660[U]

[51] Int. Cl.[2] ..... B26B 1/04

[52] U.S. Cl. ..... 30/160

[58] Field of Search ..... 30/155, 158, 160, 161

[56] References Cited

U.S. PATENT DOCUMENTS

| | | | |
|---|---|---|---|
| 2,250,290 | 7/1941 | Berg | 30/160 |
| 2,416,277 | 2/1947 | Siegel | 30/158 |
| 3,942,249 | 3/1976 | Poelmann | 30/160 |
| 4,133,106 | 1/1979 | Addis | 30/160 |

*Primary Examiner*—Jimmy C. Peters

*Attorney, Agent, or Firm*—Koda and Androlia

[57] ABSTRACT

A safety knife with basic features of a switchblade knife comprising a pair of side plates, a blade, an interplate and a pin, wherein the blade has a locking slot at a top and another locking slot at a bottom thereof, a rack insertion hole and an opening in which a shaft pin provided with gear is fixed, the rack insertion hole having such a size and being provided in such a portion of said blade that a rack can travel smoothly therethrough engaging with the gear provided around the shaft pin, and the interplate has a spring portion and a locking claw at the end of the spring portion, said locking claw being to interact with the locking slots.

2 Claims, 9 Drawing Figures

SAFETY KNIFE

BACKGROUND OF THE INVENTION p 1. Field of the Invention

This invention relates to a safety knife, and more particularly to a safety knife with basic features of a switchblade knife, wherein the action of its blade is safe.

2. Prior Art

The prior art switchblade knife, with a spring causing its blade to spring forth instantaneously when an operator tries to open the blade, is extremely dangerous. Such knives are dangerous not only for children, but for adults as well. For example, when the blade reaches an angle of approximately 90° (with respect to the handle) while the knife is being closed, there is considerable danger of the fingers being caught between the blade and handle as a result of the blade suddenly snapping closed due to an instantaneous spring action similar to that which opens the blade.

SUMMARY OF THE INVENTION

Accordingly it is the primary object of this invention to provide a safety knife with basic features of a switchblade knife wherein the danger of the action of the blade is eliminated.

In keeping with the principles of this invention, the objects of this invention are accomplished by a unique structure for a safety knife including a pair of side plates, a blade, an interplate and a pin, wherein a blade so designed that its action is totally controllable.

DETAILED DESCRIPTION OF THE INVENTION

Figure 4:
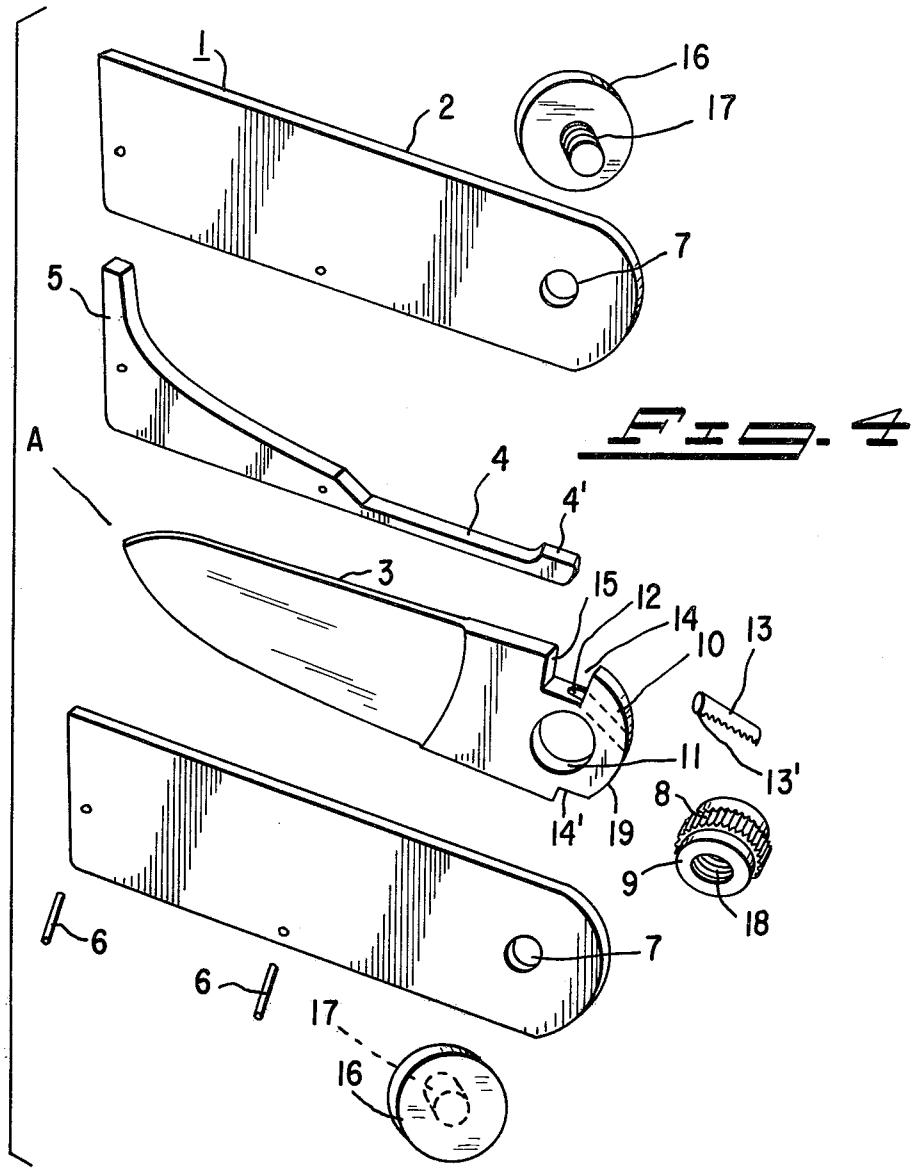
FIG. 4 is an exploded view of the safety knife.
Figure 1:
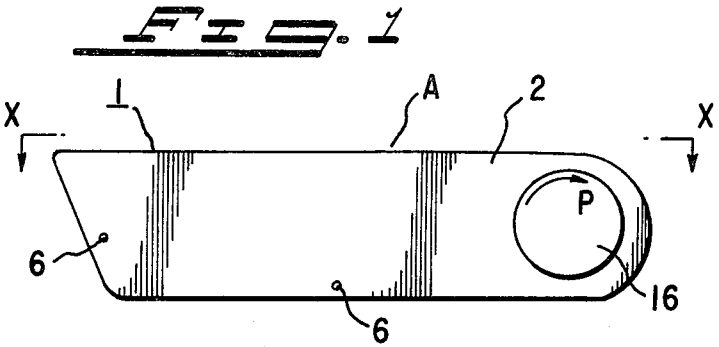
FIG. 1 is a right side view of a safety knife of this invention.
Figure 2:
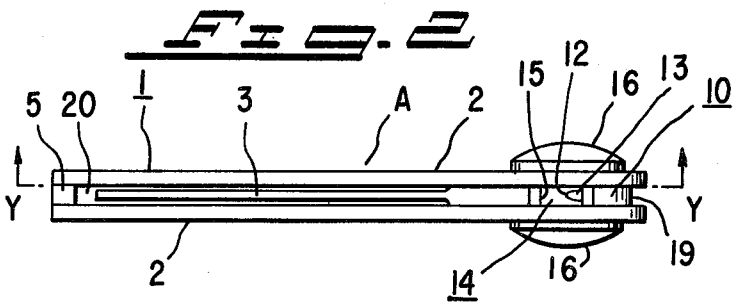
FIG. 2 is a plan view of the safety knife.
Figure 3:
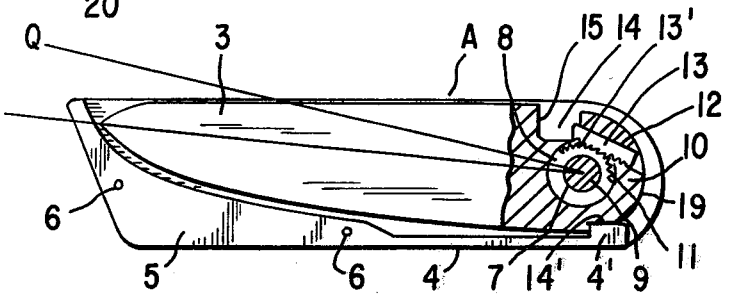
FIG. 3 is a cross-section view taken along the line Y—Y of FIG. 2.

Referring first to FIGS. 1 through 4, the handle 1 is assembled into a unit by fastening an interplate 5 between a pair of handle side plates 2, 2 by means of pins 6, 6 which interplate has an elastic spring part 4 and is reduced in depth toward one end of the handle so that it conforms to the shape of the blade 3. A shaft pin insertion hole 7 is formed in one end of each of the side plates 2, 2 so that said insertion holes 7, 7 run in a direction perpendicular to the length of the knife. Both ends of a shaft pin 9, on which a gear 8 is installed with teeth running around approximately ⅓ of the circumference of the shaft pin 9, are supported in the aforementioned shaft pin insertion holes 7, 7. A gear insertion hole 11 and a rack insertion hole 12, which runs tangentially to the gear insertion hole, are formed in the tang 10 of the aforementioned blade 3. A rack 13, one end of which acts as a blade-stopped 13', is inserted in the aforementioned rack insertion hole 12 and caused to engage with the aforementioned gear 8 inside the gear insertion hole 11. An operating edge 15, which is pressed by the tip of the rack 13 so that the blade 3 is pushed in the closing direction, is formed inside a locking slot 14 cut out of the tank 10, said edge being located at a point on a straight line constituting an extension of the rack insertion hole 12. Orbicular knobs 16, 16 are screwed into threaded holes 18, 18 formed in both ends of the aforementioned shaft pin 9. These are screwed in by means of male screws 17, 17 located on the inside surface of each knob 16. Said knobs 16, 16 are screwed in from outside the aforementioned handle side plates 2, 2. An operating edge 19 is formed around the periphery of the aforementioned tang 10. During opening and closing of the blade 3 out of and into the blade-holding groove 20 formed between the handle side plates 2, 2, the aforementioned operating edge 19 is pressed so that the blade 3 is caused to open and close slowly.

Figure 5D:
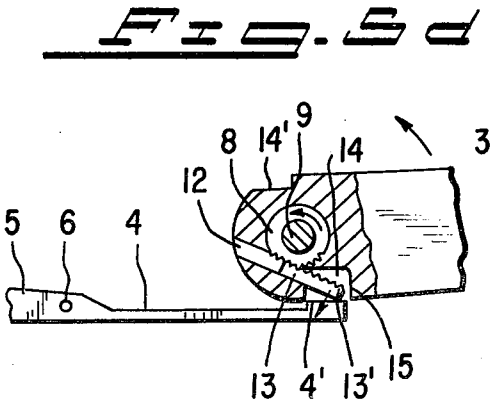
FIG. 5 (*a*)–(*e*) illustrate the operation of the safety knife.
Figure 5E:
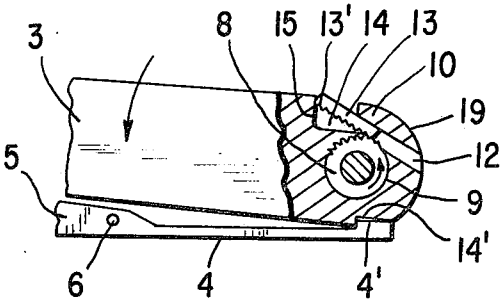
Figure 5C:
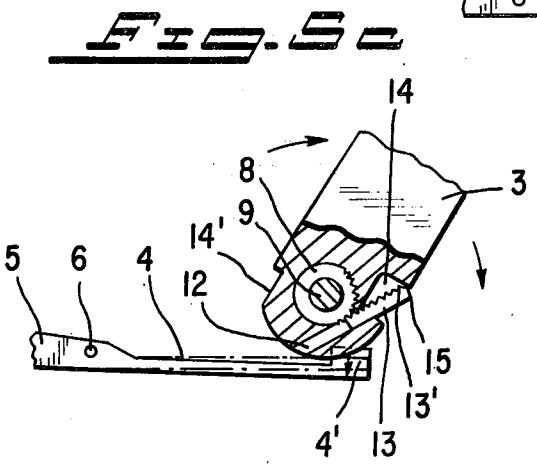
Figure 5A:
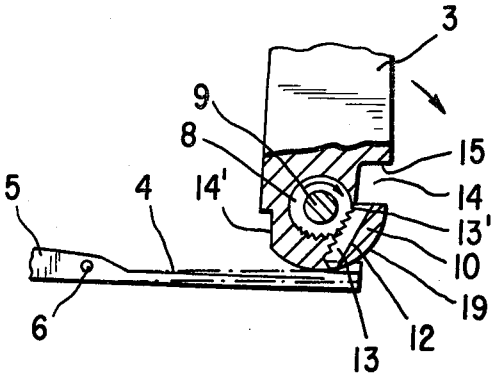
Figure 5B:
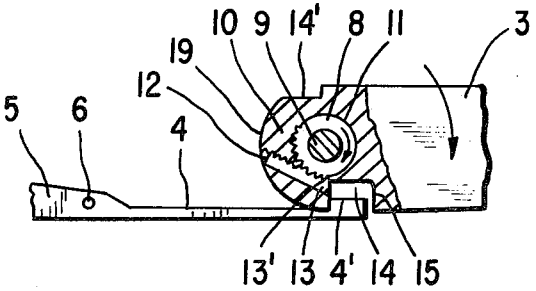

Now referring to FIG. 5 (*a*)–(*e*), while the blade 3 is in use as shown in FIG. 5 (*b*), the locking claw 4' is caused to engage with the locking slot 14 so that the blade 3 is locked in "open" position. The abovementioned features constitute the design of the knife A. Furthermore, it goes without saying that the aforementioned male screws 17, 17 and the threaded holes 18, 18 are not limited to this design; e.g., they could be replaced by polygonal tenons and mortises, etc.

In this invention, the knife A is opened for use by means of the following procedure: (a) Specifically, in order to open the blade 3 from its position in the handle 1, the handle 1 is grasped with the fingers of one hand, while the knobs 16, 16 are held between the fingers of the other hand and rotated in the direction indicated by arrow P in FIG. 1. When this is done, the blade 3 rotates 180° in the same direction as shown in FIG. 5 (a) about the shaft pin 9 from the blade-holding groove 20 to the "open" position shown in FIG. 5 (b). In this case, the blade 3 rotates in the same direction as the shaft pin 9, and as a unit with said shaft pin 9, the rotation of the gear 8 relative to the blade 3 being checked by the relative engagement position of the blade-stopper 13' located at one end of the rack 13 in the rack insertion hole 12 with respect to the gear 8. During this rotation, the operating edge 19 of the tang 10 of the blade 3 presses against the locking claw 4' located at one end of the spring part 4, which opposes the rotation of said operating edge 19, and rotates while pushing said locking claw 4' outward against the stored energy of the spring part 4 as shown by the broken line in FIG. 5 (*c*) until finally the locking claw 4' engages in the locking slot 14 located at the terminal point of the operating edge 19, so that the blade 3 is locked in its "open" position. The knife A is used with the blade in this position. After use, the knobs 16, 16 are rotated in the opposite direction, i.e., in the direction opposite that described above; as indicated by the arrow in FIG. 5 (*d*). When this is done, the rotation of the gear 8 causes the engaged rack 13 to move out of the rack insertion hole 12 and into the locking slot 14. Accordingly, the locking claw 4' is pushed out of said locking slot 14 so that the blade 3 is unlocked. As a result, the blade 3 is caused to follow the rotation of the gear 8, and therefore rotates slowly in the opposite direction, i.e., in the direction opposite that described above, so that it moves into the blade-holding groove 20 in the handle 1.

The closing of the blade 3 into the blade-holding groove 20 causes the mutual pressure between the spring part 4 and the operating edge 19 of the tang 10 to be released. This release occurs when the blade 3 has reached the angle indicated by line Q in FIG. 3.

Since this invention is designed so that the blade can be opened and closed by rotating knobs installed at both ends of the shaft pin on which the blade is mounted, it differs sharply from conventional knives with their inherent drawbacks, e.g., conventional switchblade knives with their inherent danger during opening and closing, conventional pocketknives in which the nail marks used to pull the blade out of the handle cannot be grasped with short fingernails and which cannot be used with gloves on in cold weather, etc. Specifically, the slow speed at which the blade is opened and closed in the knife provided by this invention eliminates any danger during opening and closing. Furthermore, the blade is opened and closed by rotating knobs; there is no need to use the fingernails. Accordingly, this knife is especially convenient for use in cold environments, since the knife can easily be used with gloves on. In this invention, furthermore, the blade is slowly rotated during closing by rotating the knobs until it reaches an angle where there would be absolutely no danger even if the fingertips should touch the blade. Accordingly, the knife provided by this invention is extremely safe.

I claim

1. A safety knife comprising a pair of side plates, a blade, an interplate and a pin, wherein said blade has a locking slot at a top and another locking slot at a bottom thereof, a rack insertion hole and an opening in which a shaft pin provided with gear is fixed, said rack insertion hole having such a size and being provided in such a portion of said blade that a rack can travel smoothly therethrough engaging with the gear provided around said shaft pin, and said interplate has a spring portion and a locking claw at the end of said spring portion, said locking claw being to interact with said locking slots.

2. A safety knife according to claim 1, wherein said pin comprises a male part and a female part and a head portion of said male and female parts from a knob thereby allowing an operator to grab said knob to rotate said blade around said pin.

* * * * *